US007090254B1

(12) United States Patent
Pietras et al.

(10) Patent No.: US 7,090,254 B1
(45) Date of Patent: Aug. 15, 2006

(54) APPARATUS AND METHOD ALIGNING TUBULARS

(76) Inventors: Bernd-Georg Pietras, Sandriedenveg 12, D-3001 Wedemark 2 (DE); Martin Liess, Stockener Strasse 12, D-30926 Seeze (DE)

( * ) Notice: Subject to any disclaimer, the term of this patent is extended or adjusted under 35 U.S.C. 154(b) by 0 days.

(21) Appl. No.: 09/958,917

(22) PCT Filed: Mar. 31, 2000

(86) PCT No.: PCT/GB00/01246

§ 371 (c)(1),
(2), (4) Date: Jan. 29, 2002

(87) PCT Pub. No.: WO00/61906

PCT Pub. Date: Oct. 19, 2000

(30) Foreign Application Priority Data

Apr. 13, 1999 (GB) ..... 9908359.4

(51) Int. Cl.
*E21B 19/16* (2006.01)

(52) U.S. Cl. ..... 285/18; 285/24; 285/27; 166/77.51; 166/85.5; 166/379; 166/380; 81/57.19; 81/57.34

(58) Field of Classification Search ..... 285/18, 285/24, 27, 31; 166/77.51, 77.53, 85.5, 379, 166/380; 81/57.15, 57.16, 57.19, 57.2, 57.33, 81/57.34, 57.44
See application file for complete search history.

(56) References Cited

U.S. PATENT DOCUMENTS

| | | | | |
|---|---|---|---|---|
| 1,150,178 A | | 8/1915 | Deifendorf | |
| 1,386,908 A | | 8/1921 | Taylor | |
| 1,842,638 A | | 1/1932 | Wigle | |
| 2,214,194 A | | 9/1940 | Frankley | |
| 2,214,429 A | | 9/1940 | Miller | |
| 2,522,444 A | | 9/1950 | Grable | |
| 2,566,651 A | | 9/1951 | Edelberg | |
| 2,610,690 A | | 9/1952 | Beatty | |
| 2,639,894 A | | 9/1953 | Smith | |
| 2,950,639 A | | 8/1960 | Mason | |
| 3,021,739 A | | 2/1962 | Grundmann | |
| 3,041,901 A | * | 7/1962 | Knights | 81/57.34 |
| 3,086,413 A | | 4/1963 | Mason | |
| 3,122,811 A | | 3/1964 | Gilreath | |
| 3,131,586 A | | 5/1964 | Wilson | |

(Continued)

FOREIGN PATENT DOCUMENTS

DE 2 128 362 1/1972

(Continued)

OTHER PUBLICATIONS

PCT International Search Report dated Jun. 28, 2000, for international application serial No. PCT/GB00/01246.

(Continued)

*Primary Examiner*—James M. Hewitt

(57) ABSTRACT

In one aspect, an apparatus for aligning tubulars is provided, comprising at least one guide, a tong, and a backup unit, wherein the guide is arranged on or between the tong and the backup unit, and wherein the guide is, in use, movable towards and away from the tubular with respect to the backup unit. In another aspect, an apparatus for aligning tubulars is provided, comprising a tong, a backup unit, at least one torsion post arranged therebetween, and at least one guide, the guide mounted on the torsion post. In another aspect, a method for aligning tubulars using the apparatus of the invention is provided, comprising moving the guide towards and away from the tubular with respect to the backup unit.

33 Claims, 8 Drawing Sheets

U.S. PATENT DOCUMENTS

| | | | | |
|---|---|---|---|---|
| 3,180,186 | A | 4/1965 | Catland | |
| 3,220,245 | A * | 11/1965 | Van Winkle | 285/27 |
| 3,302,496 | A | 2/1967 | Mitchell et al. | |
| 3,349,455 | A | 10/1967 | Doherty | |
| 3,443,291 | A | 5/1969 | Doherty | |
| 3,475,038 | A * | 10/1969 | Matherne | 285/27 |
| 3,518,903 | A * | 7/1970 | Ham et al. | 81/57.16 |
| 3,559,739 | A | 2/1971 | Hutchinson | |
| 3,606,664 | A | 9/1971 | Weiner | |
| 3,680,412 | A | 8/1972 | Mayer et al. | |
| 3,722,331 | A | 3/1973 | Radulescu | |
| 3,747,675 | A | 7/1973 | Brown | |
| 3,796,418 | A | 3/1974 | Carlberg | |
| 3,808,916 | A | 5/1974 | Porter et al. | |
| 3,838,613 | A | 10/1974 | Wilms | |
| 3,902,385 | A | 9/1975 | Haby | |
| 3,933,108 | A | 1/1976 | Baugh | |
| 3,941,348 | A | 3/1976 | Mott | |
| 3,986,564 | A | 10/1976 | Bender | |
| 4,005,621 | A | 2/1977 | Turner, Jr. et al. | |
| 4,023,449 | A | 5/1977 | Boyadjieff | |
| 4,142,739 | A | 3/1979 | Billingsley | |
| 4,159,367 | A | 6/1979 | Berchielli et al. | |
| 4,170,908 | A | 10/1979 | Peveto et al. | |
| 4,202,225 | A | 5/1980 | Sheldon et al. | |
| 4,215,602 | A | 8/1980 | Carstensen et al. | |
| 4,221,269 | A | 9/1980 | Hudson | |
| 4,246,809 | A | 1/1981 | Keast et al. | |
| 4,257,442 | A | 3/1981 | Claycomb | |
| 4,262,693 | A | 4/1981 | Giebeler | |
| 4,280,380 | A | 7/1981 | Eshghy | |
| 4,291,762 | A * | 9/1981 | Gudgel | 166/85.4 |
| 4,295,527 | A * | 10/1981 | Russe | 166/380 |
| 4,315,553 | A | 2/1982 | Stallings | |
| 4,334,444 | A | 6/1982 | Carstensen et al. | |
| 4,346,629 | A | 8/1982 | Kinzbach | |
| 4,401,000 | A * | 8/1983 | Kinzbach | 81/57.2 |
| 4,402,239 | A | 9/1983 | Mooney | |
| 4,403,666 | A | 9/1983 | Willis | |
| 4,442,892 | A | 4/1984 | Delesandri | |
| RE31,699 | E | 10/1984 | Eckel | |
| 4,492,134 | A | 1/1985 | Reinholdt et al. | |
| 4,497,224 | A | 2/1985 | Jurgens | |
| 4,499,919 | A | 2/1985 | Forester | |
| 4,565,003 | A | 1/1986 | McLeod | |
| 4,572,036 | A | 2/1986 | Renfro | |
| 4,573,359 | A * | 3/1986 | Carstensen | 73/761 |
| 4,592,125 | A | 6/1986 | Skene | |
| 4,593,773 | A | 6/1986 | Skeie | |
| 4,643,259 | A | 2/1987 | Zeringue, Jr. | |
| 4,648,292 | A | 3/1987 | Haynes et al. | |
| 4,649,777 | A | 3/1987 | Buck | |
| 4,709,766 | A | 12/1987 | Boyadjieff | |
| 4,712,284 | A | 12/1987 | Coyle, Sr. et al. | |
| 4,715,625 | A | 12/1987 | Shows, Jr. et al. | |
| 4,732,373 | A | 3/1988 | Yang | |
| 4,738,145 | A | 4/1988 | Vincent et al. | |
| 4,739,681 | A | 4/1988 | Pietras | |
| 4,773,218 | A | 9/1988 | Wakita et al. | |
| 4,811,635 | A | 3/1989 | Falgout, Sr. | |
| 4,821,814 | A | 4/1989 | Willis et al. | |
| 4,869,137 | A | 9/1989 | Slator | |
| 4,895,056 | A | 1/1990 | Schulze-Beckinghausen | |
| 4,938,109 | A | 7/1990 | Torres et al. | |
| 4,969,638 | A | 11/1990 | Yang | |
| 4,979,356 | A | 12/1990 | Vatne | |
| 5,000,065 | A | 3/1991 | Haynes | |
| 5,022,472 | A | 6/1991 | Bailey et al. | |
| 5,044,232 | A | 9/1991 | Schulze-Beckinghausen | |
| 5,054,440 | A | 10/1991 | Kadokawa | |
| 5,092,399 | A | 3/1992 | Lang | |
| RE34,063 | E | 9/1992 | Vincent et al. | |
| 5,150,642 | A | 9/1992 | Moody et al. | |
| 5,159,860 | A * | 11/1992 | Pietras | 81/57.19 |
| 5,161,438 | A * | 11/1992 | Pietras | 81/57.16 |
| 5,167,173 | A | 12/1992 | Pietras | |
| 5,172,613 | A | 12/1992 | Wesch, Jr. | |
| 5,209,302 | A | 5/1993 | Robichaux et al. | |
| 5,221,099 | A | 6/1993 | Jansch | |
| 5,259,275 | A * | 11/1993 | Schulze-Beckinghausen | 81/57.16 |
| 5,297,833 | A | 3/1994 | Willis et al. | |
| 5,390,568 | A * | 2/1995 | Pietras | 81/57.16 |
| 5,451,084 | A | 9/1995 | Jansch | |
| 5,520,072 | A | 5/1996 | Perry | |
| 5,634,671 | A * | 6/1997 | Watkins | 285/18 |
| 5,667,026 | A | 9/1997 | Lorenz et al. | |
| 5,706,893 | A | 1/1998 | Morgan | |
| 5,730,471 | A * | 3/1998 | Schulze-Beckinghausen et al. | 285/18 |
| 5,746,276 | A | 5/1998 | Stuart | |
| 5,787,982 | A | 8/1998 | Bakke | |
| 5,819,605 | A | 10/1998 | Buck et al. | |
| 5,839,330 | A | 11/1998 | Stokka | |
| 5,842,390 | A * | 12/1998 | Bouligny et al. | 81/57.34 |
| 5,845,549 | A * | 12/1998 | Bouligny | 81/57.33 |
| 5,890,549 | A | 4/1999 | Sprehe | |
| 5,992,801 | A | 11/1999 | Torres | |
| 5,996,444 | A | 12/1999 | Pearce et al. | |
| 6,047,775 | A | 4/2000 | Mock | |
| 6,065,372 | A | 5/2000 | Rauch | |
| 6,082,224 | A * | 7/2000 | McDaniels et al. | 81/57.15 |
| 6,082,225 | A | 7/2000 | Richardson | |
| 6,119,772 | A | 9/2000 | Pruet | |
| 6,138,529 | A * | 10/2000 | Pietras | 81/57.33 |
| 6,142,041 | A | 11/2000 | Buck | |
| 6,161,617 | A | 12/2000 | Gjedebo | |
| 6,206,096 | B1 | 3/2001 | Belik | |
| 6,223,629 | B1 | 5/2001 | Bangert | |
| 6,253,845 | B1 | 7/2001 | Belik | |
| 6,276,238 | B1 | 8/2001 | Junck et al. | |
| 6,288,373 | B1 | 9/2001 | Jahn et al. | |
| 6,305,720 | B1 * | 10/2001 | Spiering et al. | 285/18 |
| 6,315,051 | B1 | 11/2001 | Ayling | |
| 6,327,938 | B1 * | 12/2001 | Pietras | 81/57.33 |
| 6,330,911 | B1 | 12/2001 | Allen et al. | |
| 6,332,377 | B1 | 12/2001 | Pietras et al. | |
| 6,334,376 | B1 * | 1/2002 | Torres | 81/372 |
| 6,360,633 | B1 | 3/2002 | Pietras | |
| 6,374,706 | B1 | 4/2002 | Newman | |
| 6,412,554 | B1 | 7/2002 | Allen et al. | |
| 6,480,811 | B1 | 11/2002 | Denny et al. | |
| 6,527,047 | B1 | 3/2003 | Pietras | |
| 6,598,501 | B1 | 7/2003 | Schulze-Beckinghausen et al. | |
| 6,612,184 | B1 | 9/2003 | Hollingsworth et al. | |
| 6,622,796 | B1 | 9/2003 | Pietras | |
| 6,668,398 | B1 | 12/2003 | Lane | |
| 6,668,684 | B1 | 12/2003 | Allen et al. | |
| 6,695,559 | B1 | 2/2004 | Pietras | |
| 6,705,405 | B1 | 3/2004 | Pietras | |
| 6,725,938 | B1 | 4/2004 | Pietras | |
| 6,745,646 | B1 | 6/2004 | Pietras et al. | |
| 6,748,823 | B1 | 6/2004 | Pietras | |
| 6,814,149 | B1 | 11/2004 | Liess et al. | |
| 2001/0025551 | A1 | 10/2001 | Pietras | |
| 2001/0042625 | A1 | 11/2001 | Appleton | |
| 2002/0157823 | A1 | 10/2002 | Pietras et al. | |
| 2003/0075023 | A1 | 4/2003 | Robichaux | |
| 2004/0011531 | A1 | 1/2004 | Pietras | |
| 2004/0026088 | A1 | 2/2004 | Pietras et al. | |
| 2004/0035573 | A1 | 2/2004 | Pietras | |
| 2004/0136813 | A1 | 7/2004 | Pietras | |
| 2004/0149451 | A1 | 8/2004 | Pietras | |
| 2004/0154835 | A1 | 8/2004 | Allen et al. | |

| | | | |
|---|---|---|---|
| 2004/0173357 | A1 | 9/2004 | Pietras |
| 2004/0188098 | A1 | 9/2004 | Schulze-Beckinghausen et al. |
| 2004/0194965 | A1 | 10/2004 | Pietras |
| 2004/0216924 | A1 | 11/2004 | Pietras et al. |
| 2004/0237726 | A1 | 12/2004 | Schulze-Beckinghausen |

FOREIGN PATENT DOCUMENTS

| | | | |
|---|---|---|---|
| EP | 0 285 386 | | 5/1988 |
| EP | 0 285 386 | | 10/1988 |
| EP | 0 311 455 | | 4/1989 |
| EP | 0 339 005 | | 10/1989 |
| EP | 0 423 055 | A2 | 4/1991 |
| EP | 0 432 055 | | 4/1991 |
| EP | 0 525 247 | A1 | 2/1993 |
| EP | 0 525 247 | | 3/1993 |
| GB | 804798 | | 11/1958 |
| GB | 1 215 967 | | 12/1970 |
| GB | 2 049 518 | | 12/1980 |
| GB | 2 049 518 | A | 12/1980 |
| GB | 2 115 940 | | 9/1983 |
| GB | 2 128 526 | A | 5/1984 |
| GB | 2 300 896 | | 11/1996 |
| GB | 2 300 896 | A | 11/1996 |
| GB | 2 346 576 | A | 8/2000 |
| GB | 2 346 577 | A | 8/2000 |
| GB | 2 352 667 | | 2/2001 |
| WO | WO 83/03443 | | 10/1983 |
| WO | WO 92/18744 | | 10/1992 |
| WO | WO 93/18276 | | 9/1993 |
| WO | WO 95/20471 | | 8/1995 |
| WO | WO 98/16716 | | 4/1998 |
| WO | WO 98/32948 | | 7/1998 |
| WO | WO 99/34089 | | 7/1999 |
| WO | WO 99/34090 | | 7/1999 |
| WO | WO 99/34091 | | 7/1999 |
| WO | WO 00/22278 | | 4/2000 |
| WO | WO 00/23686 | | 4/2000 |
| WO | WO 00/45026 | | 8/2000 |
| WO | WO 00/45027 | | 8/2000 |
| WO | WO 00/045027 | | 8/2000 |
| WO | WO 00/74899 | | 12/2000 |
| WO | WO 00/79092 | A2 | 12/2000 |
| WO | WO 01/03889 | A1 | 1/2001 |
| WO | WO 01/09479 | A1 | 2/2001 |
| WO | WO 01/38688 | A1 | 5/2001 |
| WO | WO 01/66905 | A2 | 9/2001 |
| WO | WO 01/81047 | | 11/2001 |

OTHER PUBLICATIONS

U.S. Appl. No. 10/850,354, entitled "Apparatus and Methods for Connecting Tubulars" filed May 20, 2004.

U.S. Appl. No. 10/765,567, entitled "Wrenching Unit", filed Jan. 27, 2004.

U.S. Appl. No. 10/681,570, entitled "Tong Asssembly", filed Oct. 8, 2003.

U.S. Appl. No. 09/762,699, entitled "Methods and Apparatus for Connecting Tubulars Using a Top Drive", filed May 10, 2001.

International Search Report, International Application No. PCT/GB01/00781, dated Sep. 27, 2001.

PCT International Search Report, International Application No. PCT/US 03/03195, dated Oct. 22, 2003.

PCT International Preliminary Examination Report from International Application PCT/GB00/04383, dated Feb. 26, 2002.

PCT Search Report, International Application No. PCT/US2004/006753, dated Sep. 8, 2004.

U.K. Search Report, Application No. GB/0422176.8 dated Jan. 5, 2005.

U.S. Appl. No. 10/681,570, filed Oct. 8, 2003, Pietras et al.; Tong Assembly.

* cited by examiner

APPARATUS AND METHOD ALIGNING TUBULARS

BACKGROUND OF THE INVENTION

1. Field of the Invention

This invention relates to an apparatus and a method for aligning tubulars.

2. Description of the Related Art

During the construction, maintenance and repair of oil and gas wells it is necessary to connect a large number of tubulars, for example lengths of drill pipe or casing. Conventionally the upper end of a tubular is provided with a threaded socket or box whilst the lower end is provided with a threaded pin which is slightly tapered.

In practice it is very easy for the pin of one tubular to be incorrectly inserted into the socket of another tubular with the result that the threads on one or both the pin and the socket can readily be damaged.

Considerable skill is required to correctly align tubulars and historically this task has been undertaken by a highly experienced rig-hand called a "stabber".

In order to facilitate correct alignment a device known as a "stabbing guide" is frequently used. One such stabbing guide comprises a plastic body member which can be mounted on the socket of a pipe held in slips. The plastic body member has a central passageway the upper part of which defines a funnel which leads into a lower passageway which is concentric with the socket. In use, as the upper tubular is lowered, its pin enters the funnel of the stabbing guide and then travels down the lower passageway into the socket. The stabbing guide (which comprises two semi-circular pieces hinged together around the socket) is then removed and the tubulars are screwed together and tightened to the required torque either by a power tong or a tong assembly comprising a power tong and a backup tong.

It has been observed that an accuracy in alignment of approximately 1 mm is required to inhibit problems associated with thread misalignment.

PCT Publication Number WO 98/32948, owned by the applicants for the present application, discloses an apparatus for aligning tubulars which apparatus comprises a guide mounted on one of a power tong and a backup tong.

It has been observed that the prior art apparatus, although reasonably accurate, is not suitable for multiple uses where accuracy is paramount and with little physical input from rig hands.

SUMMARY OF THE INVENTION

Accordingly, the present invention provides an apparatus for aligning tubulars which apparatus comprises at least one guide, a tong and a backup unit wherein said at least one guide is arranged on or between said tong and said backup unit, characterized in that said at least one guide is, in use, movable towards and away from a box of a tubular with respect to said backup unit. The at least one guide may be shaped to act like a funnel in guiding a pin into a box. The guide is moveable in a substantially radial direction towards and away from the centre of the backup unit.

Preferably, the apparatus further comprises a piston and cylinder, wherein the at least one guide is moveable towards and away from a box of a tubular through the operation of said piston and cylinder. The piston and cylinder may be activated by pneumatic or preferably, hydraulic fluid.

Advantageously, the apparatus further comprises an axle wherein the at least one guide is moveable thereabout.

Preferably, the apparatus further comprises a guide holder. Advantageously, the apparatus comprises two guides which are attachable to the guide holder.

Preferably, the apparatus further comprises a spring which biases said at least one guide to an open position.

Advantageously, the apparatus further comprises at least one torque post wherein said at least one guide is attachable thereto.

Preferably, the apparatus further comprises a bracket wherein said at least one guide is moveable with respect to said bracket.

Advantageously, said at least one guide is made from an elastomeric material.

The invention also provides an apparatus for aligning tubulars which apparatus comprises a tong, a backup unit, at least one torsion post arranged therebetween, the apparatus further comprising at least one guide, characterised in that said at least one guide is mounted on said at least one torsion post.

The invention also provides a method for aligning tubulars using the apparatus of the invention, comprising the step of moving said at least one guide towards and away from a box of a tubular with respect to said backup unit.

BRIEF DESCRIPTION OF THE DRAWINGS

For a better understanding of the present invention reference will now be made, by way of example, to the accompanying drawings, in which.

DETAILED DESCRIPTION OF THE PREFERRED EMBODIMENT

Figure 1:
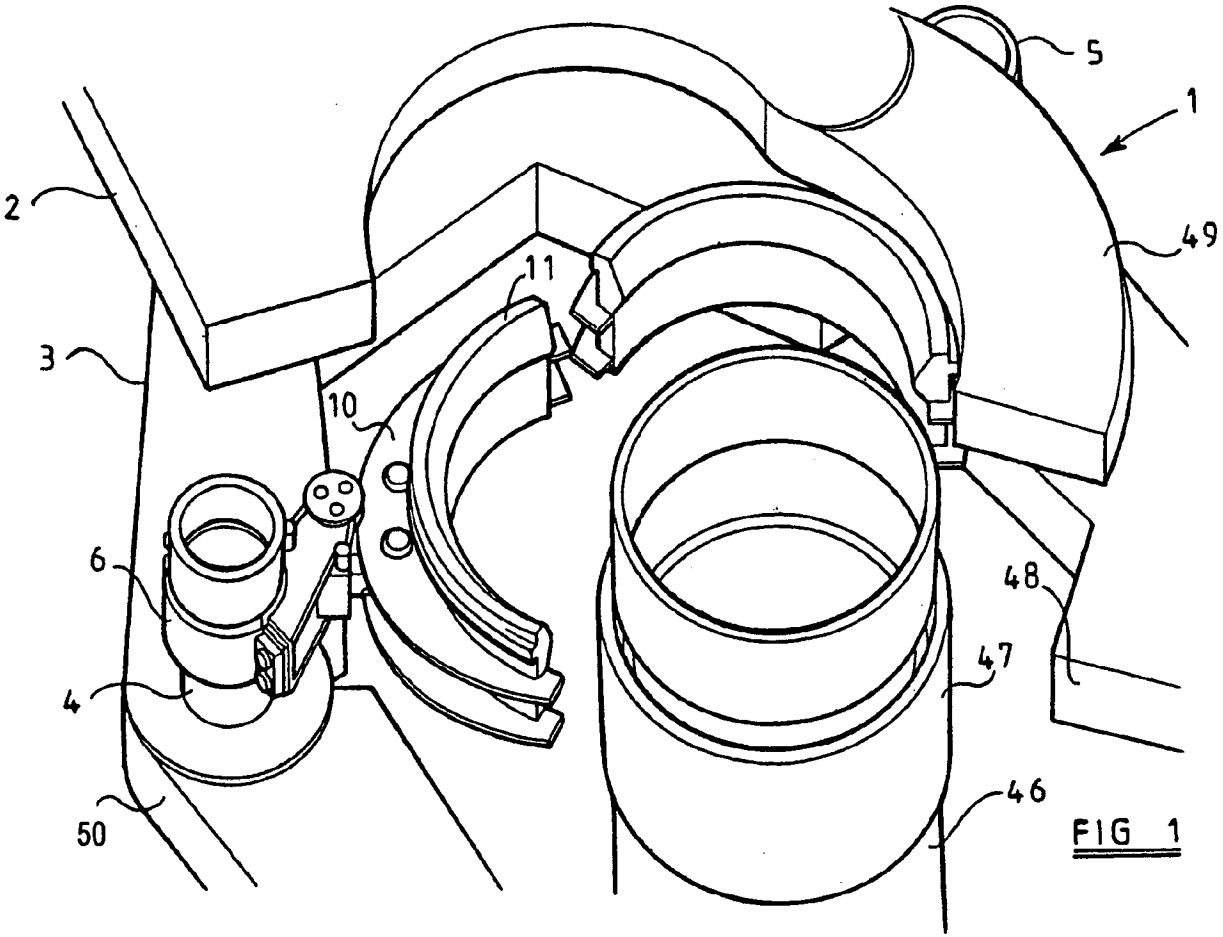
FIG. 1 is a perspective schematic view of a first embodiment of an apparatus of the present invention in a first stage of operation, with parts cut away.
Figure 2:
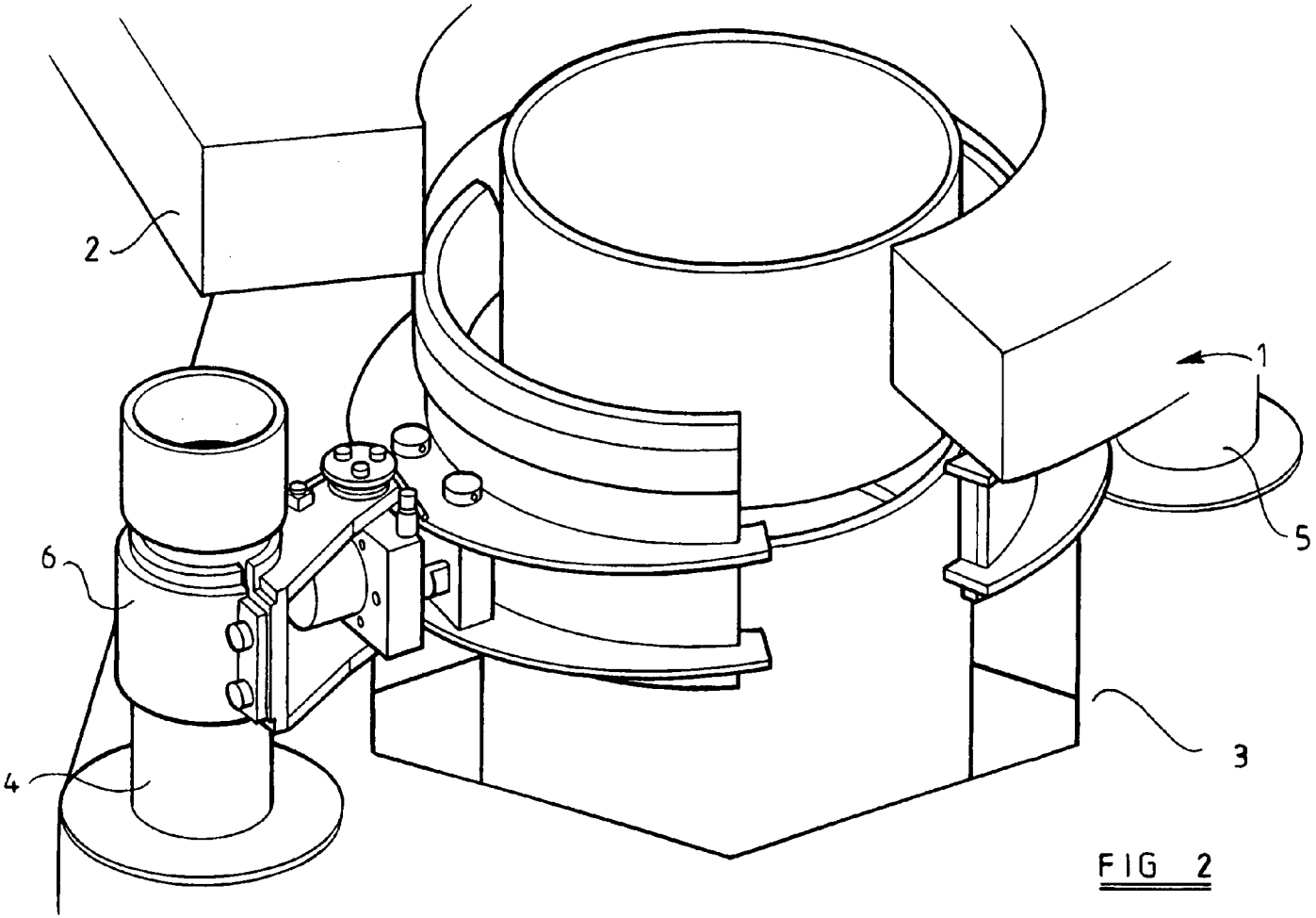
FIG. 2 is an enlarged perspective schematic view of the apparatus of FIG. 1 in a second stage of operation.

Referring to FIGS. 1 to 7, there is shown an apparatus generally identified by reference numeral 1.

The apparatus 1 comprises a power tong 2 and a backup tong 3. Torsion posts 4 and 5 are arranged between the power tong 2 and the backup tong 3 on opposing sides thereof.

Figure 3:
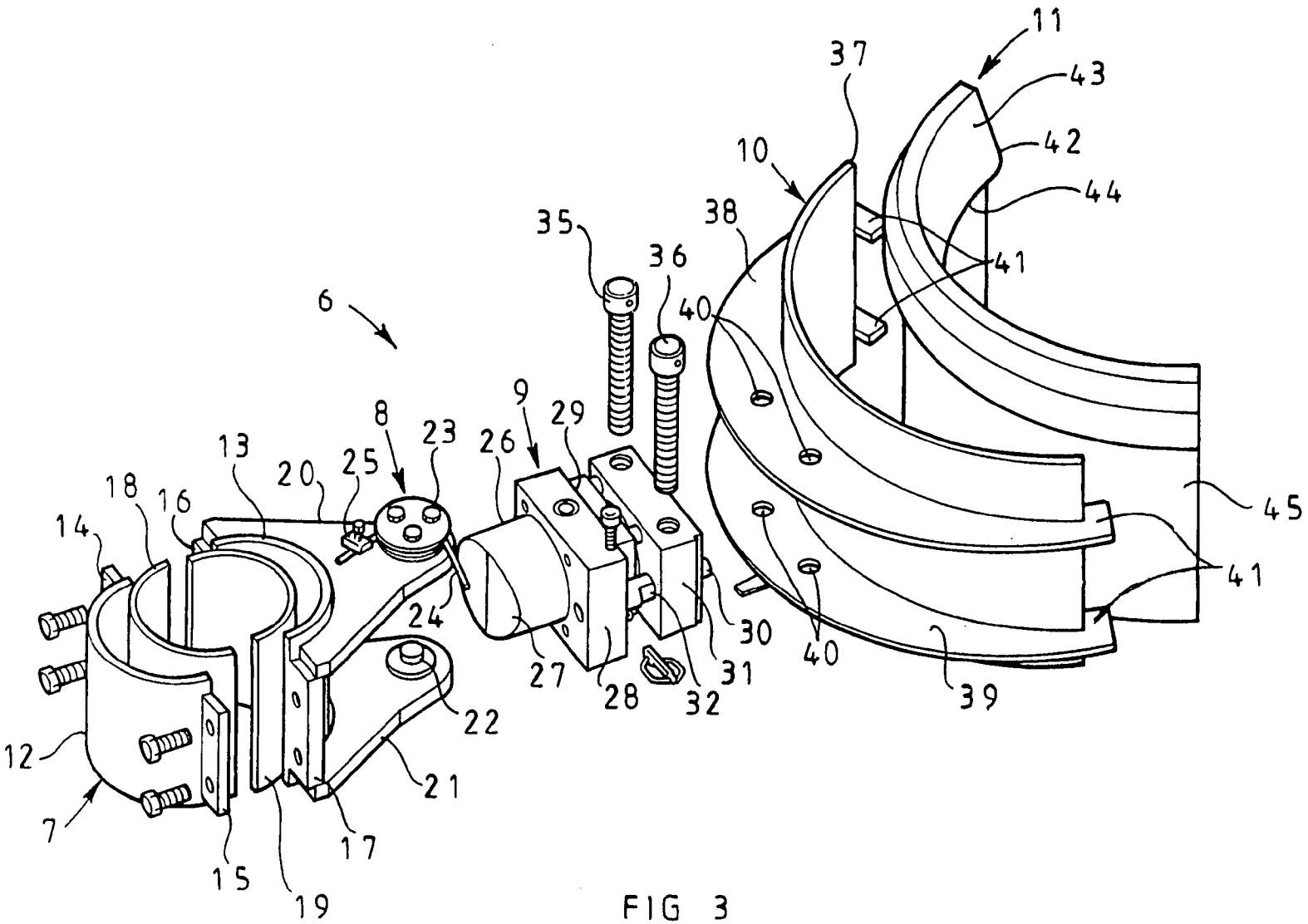
FIG. 3 is an exploded perspective view of part of the apparatus of FIG. 1.
Figure 4:
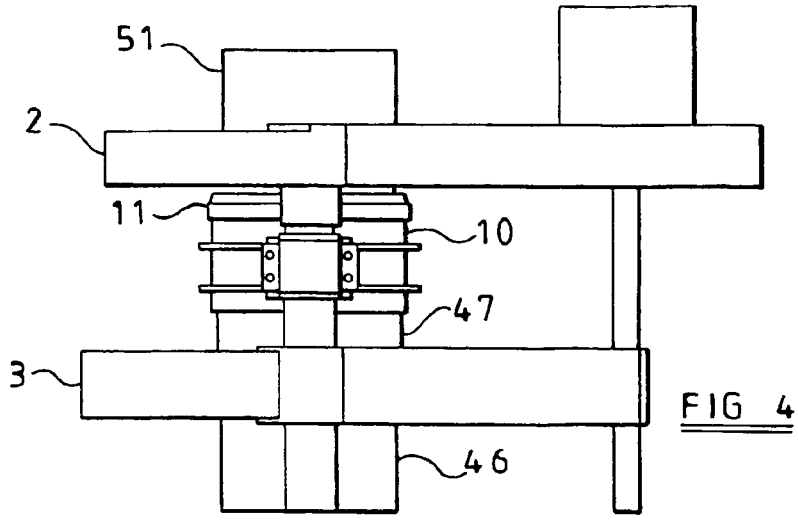
FIG. 4 is a side plan view of the apparatus of FIG. 1, in the second stage of operation.

A guide unit 6 is provided on each of the torsion posts 4 and 5. Referring to FIG. 3, each guide unit 6 comprises a clamp 7, a spring 8, a piston and cylinder unit 9, a guide shoe holder 10 and a guide shoe 11. The guide units 6 may be mirror images of each other.

The clamp 7 comprises two semi-cylindrical parts 12 and 13 which are bolted together via lugs 14, 15, arid 16 and 17. Semi-cylindrical sleeves 18 and 19 lie between the semi-cylindrical parts and the torsion post 4, 5 on which the clamp 7 is mounted. The semi-cylindrical part 13 is provided with upper and lower substantially horizontal lugs 20 and 21. The lugs 20 and 21 are substantially triangular and are provided with stub axles 22 and (not shown) at the apexes.

The spring 8 comprises a reel 23 fixed to the upper lug 20 and a spring wire 24 wrapped around the reel 23. The spring wire 24 has two ends extending from the reel 23 substantially at a tangent thereto. One of the ends is retained in a clamping element 25 which is fixed to the upper lug 20, and the other end contacts, and is biased against a pin 26 arranged on one side of the piston and cylinder unit 9.

Figure 5:
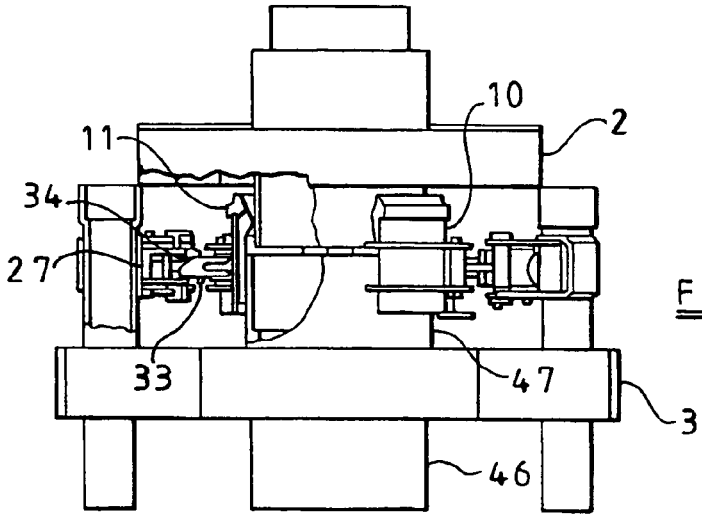
FIG. 5 is a front plan view of the apparatus of FIG. 1, in the second stage of operation, with parts cut away arid parts shown in cross-section.
Figure 6:
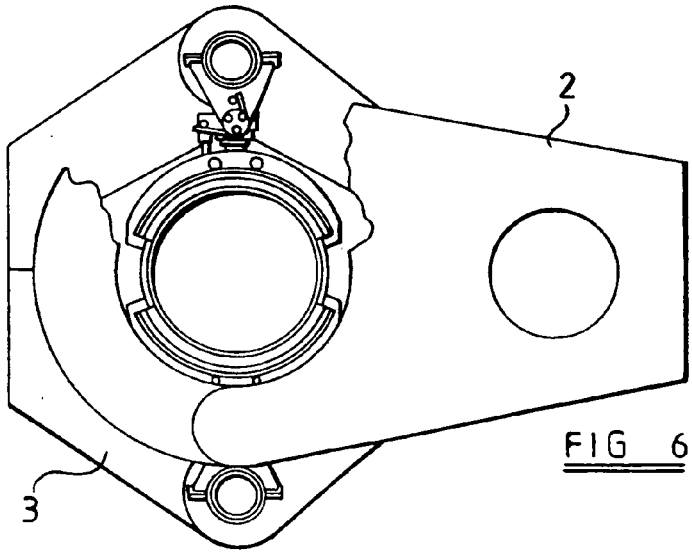
FIG. 6 is a top plan view of the apparatus of FIG. 1, in the second stage of operation, with parts cut away.

The piston and cylinder unit 9 comprises a cylinder 27 which has a square neck portion 28 at a front end thereof. Holes 29 are provided in the top centre and bottom centre of the square neck portion 28 for receiving the axle stubs (22 and not shown). The piston and cylinder unit 9 is moveable about stub axles 22 and (not shown) against spring 8. The square neck portion 28 is also provided with posts 30 and (not shown) on opposing sides thereof which are fixed thereto. A block 31 is provided with holes 32 and (not shown) for slideably receiving the posts 30 and (not shown). The block 31 is attached to one end of a piston rod 33 (FIG. 5). A piston 34 is attached to the opposing end of the piston rod 33. The piston 34 is slideably arranged in the cylinder 27.

The block 31 is connected to a guide shoe holder 10 by bolts 35 and 36. The guide shoe holder 10 comprises a curved face 37 which is provided with reinforcing ribs 38 and 39 which are arranged substantially horizontally and spaced apart vertically. The reinforcing ribs 38 and 39 are provided with holes 40 for receiving bolts 35 arid 36. The ends of the guide shoe holder 10 are provided with lugs 41 which facilitate holding of the guide shoe 11.

The guide shoe 11 may be formed from an elastomeric material. The guide shoe 11 has a top section 42 which has an inwardly sloping angled portion 43 and a lower lip 44. A bottom section 45 is substantially flat. The top section 42 is arranged above the guide shoe holder 10.

Prior to use, a guide unit 6 is attached to each torsion posts 4 and 5 by clamps 7. The semi-cylindrical sleeves 18 and 19 inhibit rotation of the clamps 7 about the torsion posts 4 and 5.

In use, a tubular 46 such as casing or drill pipe which forms part of a string, is held in a spider in a floor of an oil or gas rig (not shown). Jaws 50 and 48 of the backup unit 3 are opened and placed around the top of the tubular 46. The top of the tubular 46 is gripped by closing the jaws 50 and 48 of the backup unit 3. The tubular 46 is gripped at a point such that the lip 44 of guide shoe 11 will be above a box 47 of the tubular 46.

Springs 8 bias the rear of the guide shoe holder 10 outwardly towards the mouth of the backup unit 3 and hence open. As the backup unit 3 is moved towards the tubular 46, the box 47 contacts the rear of the lower section 45 of the guide shoes 11. The guide shoes 11 move about the box 47 around stub axles (22 and not shown). Once the backup unit 3 has firmly gripped the tubular 46, piston and cylinders 9 are actuated by either hydraulic or pneumatic fluid, engaging and firmly pressing the lower section 45 of the guide shoe 11 against the box 47.

A section or stand of tubulars 51 is lowered through jaws 49 and (not shown) of the power tong 2. A pin on the lower end of the section or stand of tubulars is lowered into the box 47, being guided by the top section 42 of the guide shoe 11. The tubular may now be rotated by a top drive to screw the pin into the box to a low torque.

The jaws 49 and (not shown) of the power tong 2 are closed and the power tong is activated to torque the connection.

Referring now to FIGS. 7 to 11 there is shown a second embodiment of the apparatus of the present invention generally identified by reference numeral 101.

The apparatus 101 comprises a power tong 102 and a backup tong 103. Torsion posts 104 and 105 are arranged between the power tong 102 and the backup tong 103 on opposing sides thereof.

Three guide units 106, 107 and 108 are arranged about and fixed to the backup tong 103. The first guide unit 106 is fixed to a left jaw 109 of the backup tong 103, the second guide unit 107 is fixed to a rear portion 110 of the backup tong 103 and the third guide unit 108 is fixed to a right jaw III of the backup tong 103.

Figure 10:
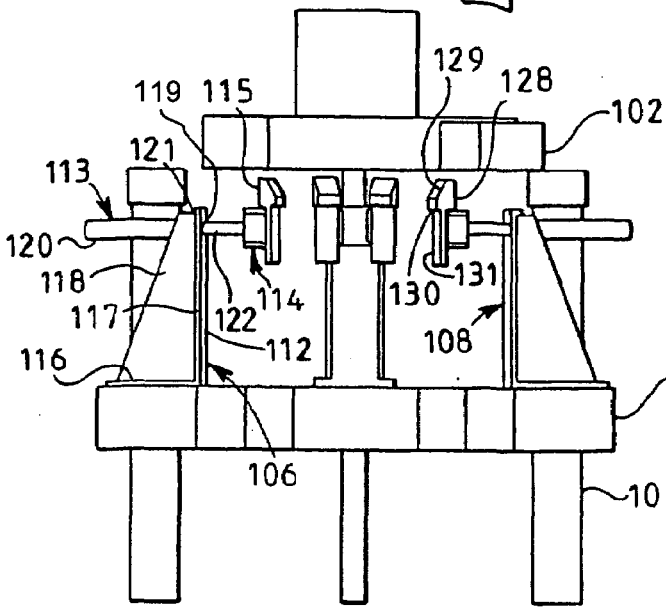
FIG. 10 is a front plan view of the apparatus of FIG. 7.
Figure 11:
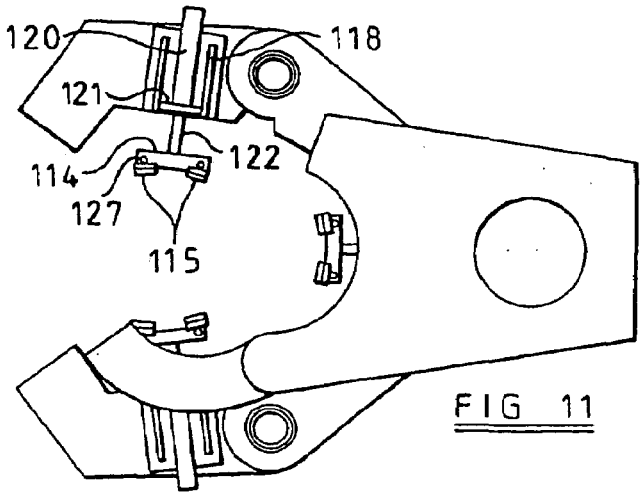
FIG. 11 is a top plan view of the apparatus of FIG. 7.
Figure 12:
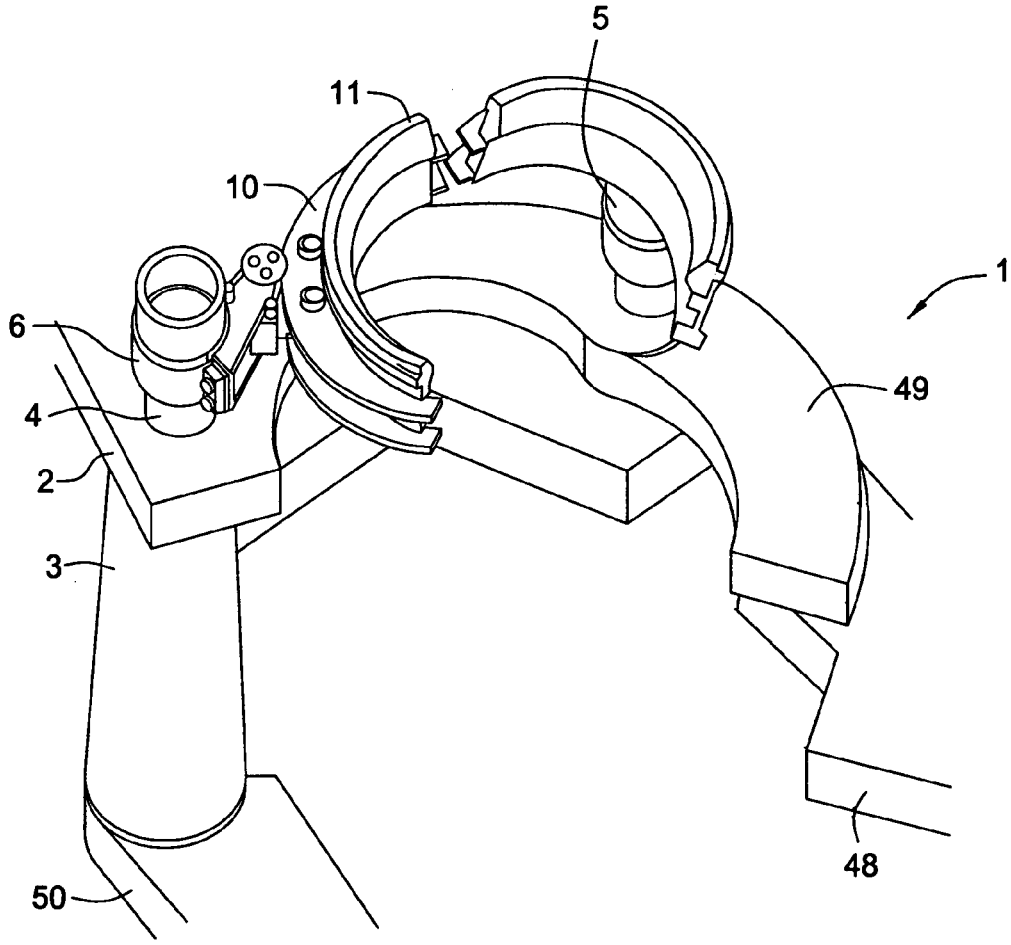
FIG. 12 is a perspective view of another embodiment of the present invention.

Referring to FIG. 10, each guide unit 106, 107 and 108 comprises a bracket 112, a piston and cylinder unit 113, a guide shoe holder 114 and two guide shoes 115.

The bracket 112 comprises a base plate 116, a vertical plate 117 arranged at the inner most point of the base plate 116, and two spaced apart strengthening plates 118 arranged therebetween.

The piston and cylinder unit 113 is located in a hole 119 through the top of the vertical plate 117. A cylinder 120 is provided with a flange 121 which is attached to the vertical plate 112. A piston 122 extends from the cylinder 120. The guide shoe holder 114 is fixed to a free extend of the piston 122.

Figure 7:
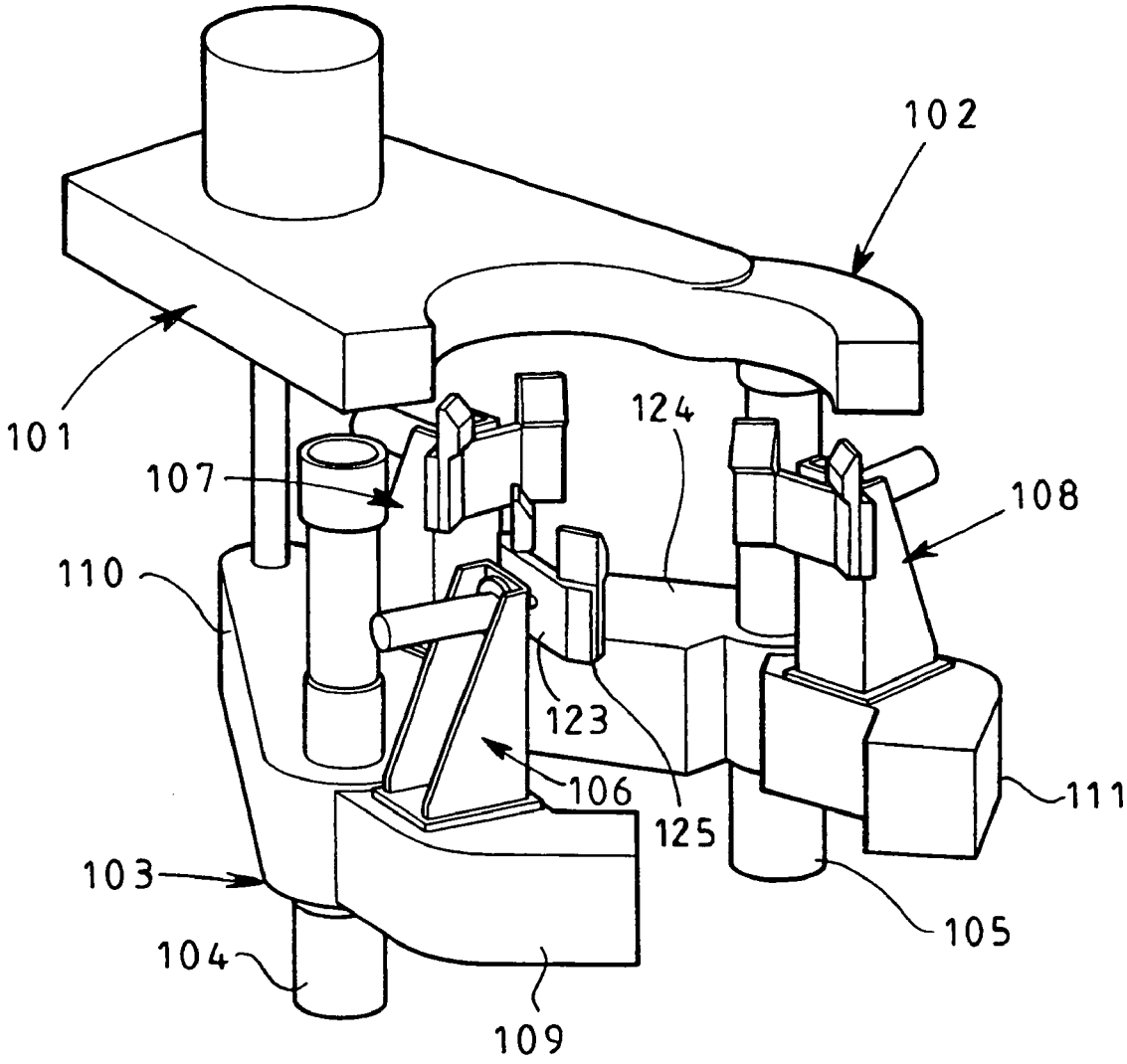
FIG. 7 is a perspective schematic view of a second embodiment of an apparatus of the present invention, in a first stage of operation, with parts cut away.
Figure 8:
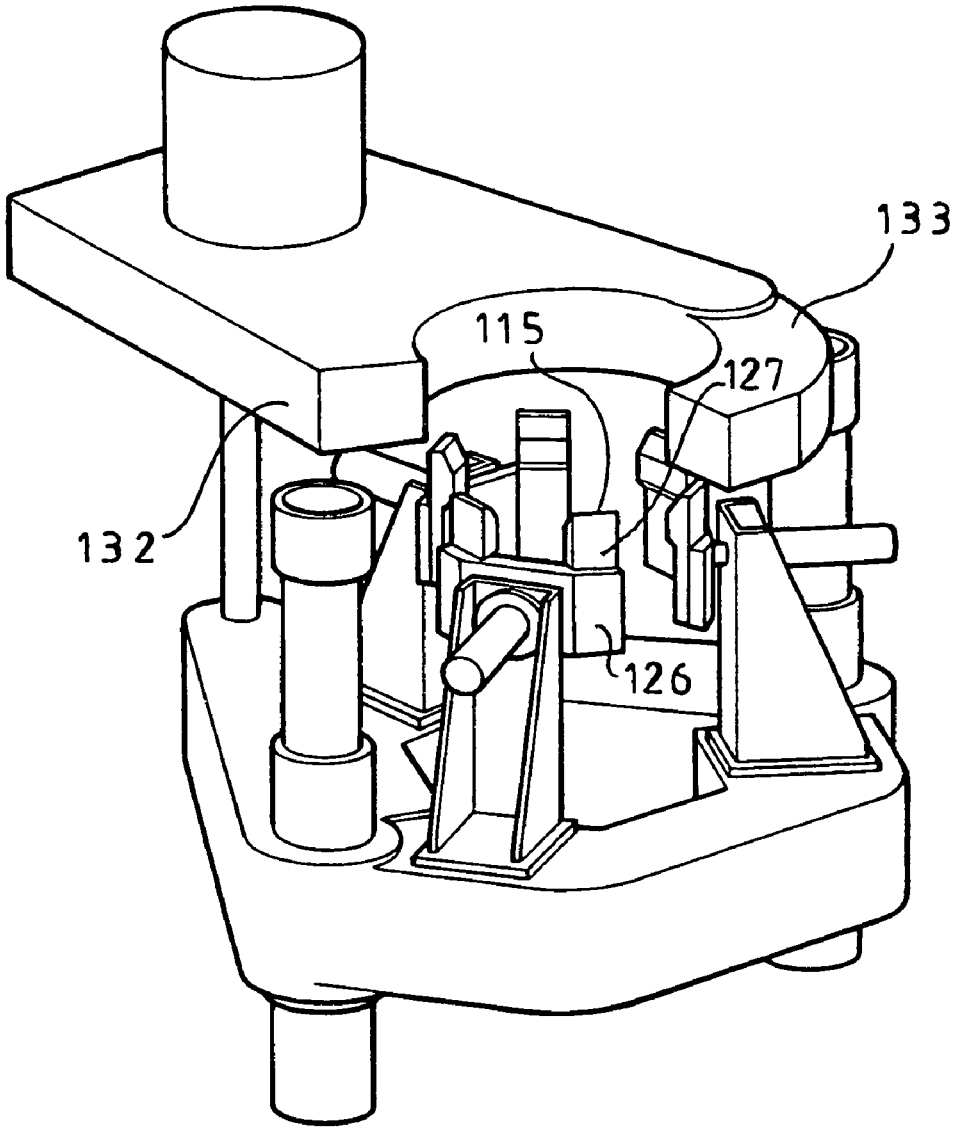
FIG. 8 is a perspective view of the apparatus of FIG. 1 in a second stage of operation, with parts cut away.
Figure 9:
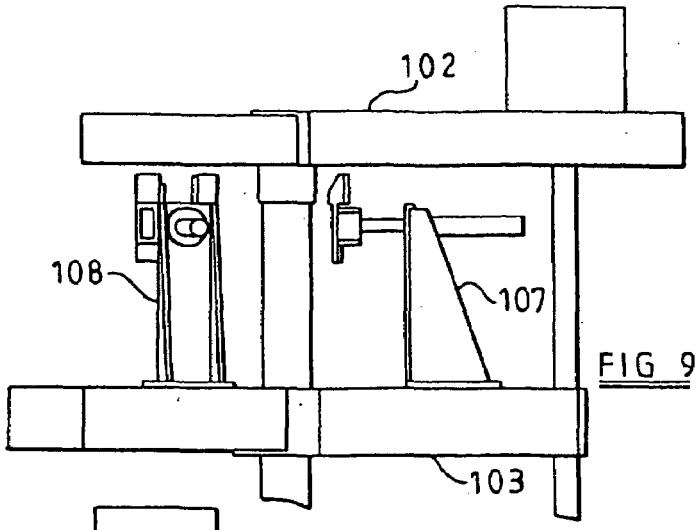
FIG. 9 is a side plan view of the apparatus of FIG. 7.

The guide shoe holder 114 comprises a central block 123 to which upper and lower horizontal bars 124 and 125 are fixed, as can best be seen in FIG. 7. Each guide shoe 115 is mounted on a block 126 which is movably disposed on a stub axle 127, as can best be seen in FIG. 8.

The guide shoe 115 is similar to that of the first embodiment, in that the guide shoe 115 may be formed from an elastomeric material. The guide shoe 115 has a top section 128 which has an inwardly sloping angled portion 129 and a lower lip 130. A bottom section 131 is substantially flat. The top section is arranged above the guide shoe holder 114.

In use, a tubular (not shown) such as casing or drill pipe which forms part of a string, is held in a spider in a floor of an oil or gas rig. Jaws 109 and 111 of the backup tong 103 are opened and placed around the top of the tubular. The top of the tubular is gripped by closing the jaws 109 and 111 of the backup tong 103. The tubular is gripped at a point such that the lip 130 of guide shoe 115 will be above a box of the tubular.

The piston and cylinders 113 are actuated by hydraulic or pneumatic fluid to engage the guide shoes 115 with the box and firmly pressing the lower section 131 of the guide shoe 115 against the box.

A section or stand of tubulars is lowered through jaws 132 and 133 of the power tong 102. A pin on the lower end of the section or stand of tubulars is lowered into the box, being guided by the top section of the guide shoe 115. The tubular may now be rotated by a top drive to screw the pin into the box to a low torque.

The jaws 132 and 133 of the power tong 102 are closed and the power tong is activated to torque the connection.

What is claimed is:

1. An apparatus for aligning first and second tubulars comprising at least one guide, a tong, and a backup unit, the backup unit comprising jaws moveable towards and away from the first tubular and the tong comprising jaws moveable towards and away from the second tubular, wherein:

the at least one guide is arranged on the tong or the backup unit, the at least one guide is movable towards and away from the first or second tubular with respect to the backup unit, and the backup unit and the tong are moveable into gripping engagement with the first and second tubulars, respectively, and the tong is capable of applying torque to rotate the second tubular relative to the first tubular.

2. The apparatus of claim 1, further comprising a piston and cylinder, wherein the at least one guide is moveable towards and away from the first or second tubular through the operation of the piston and cylinder.

3. The apparatus of claim 1, further comprising an axle around which the at least one guide is moveable.

4. The apparatus of claim 1, further comprising a guide holder.

5. The apparatus of claim 4, wherein two guides are attachable to the guide holder.

6. The apparatus of claim 1, further comprising a spring which biases the at least one guide to an open position.

7. The apparatus of claim 1, further comprising at least one torque post to which the at least one guide is attachable.

8. The apparatus of claim 7, wherein the at least one guide is directly attachable to the at least one torque post.

9. The apparatus of claim 1, further comprising a bracket, wherein the at least one guide is moveable with respect to the bracket.

10. The apparatus of claim 1, wherein the at least one guide is made from an elastomeric material.

11. The apparatus of claim 1, wherein the jaws of the tong grippingly engage the second tubular.

12. The apparatus of claim 1, wherein the at least one guide is shaped to act as a funnel to guide the second tubular therethrough.

13. The apparatus of claim 1, wherein the backup unit is moveable into gripping engagement with the first tubular independent of the movement of the at least one guide.

14. The apparatus of claim 1, wherein the at least one guide is capable of guiding a centerline of the second tubular into substantial alignment with a centerline of the first tubular grippingly engaged by the backup unit.

15. An apparatus for aligning first and second tubulars comprising:

a tong, a backup unit, and at least one torsion post arranged therebetween, the at least one torsion post attached to the tong or the backup unit and the tong capable of grippingly engaging the first tubular and capable of applying torque to the first tubular to rotate the first tubular relative to the second tubular; and at least one guide, wherein the at least one guide is mounted on the at least one torsion post and the first tubular is moveable through the at least one guide while the second tubular is grippingly engaged by the backup unit.

16. The apparatus of claim 15, wherein at least one guide is mounted on each of at least two torsion posts.

17. The apparatus of claim 16, wherein the at least two torsion posts are arranged between the tong and backup unit on opposing sides thereof.

18. The apparatus of claim 15, wherein the at least one guide is permanently mounted to the at least one torsion post.

19. The apparatus of claim 15, wherein at least one clamp inhibits rotation of the at least one guide about the at least one torsion post.

20. A method of aligning first and second tubulars, comprising:

providing an apparatus having at least one guide, a tong, and a backup unit, the backup unit comprising jaws moveable towards and away from the first tubular and the tong comprising jaws moveable towards and away from the second tubular, wherein the at least one guide is arranged on the tong or the backup unit;

gripping the first tubular using the jaws of the backup unit;

moving the at least one guide towards the first tubular with respect to the backup unit;

gripping and applying torque to rotate the second tubular relative to the first tubular using the tong; and lowering the second tubular while substantially aligning a centerline of the second tubular with a centerline of the first tubular using the at least one guide.

21. The method of claim 20, further comprising rotating the second tubular with the tong, thereby rotatably connecting the first and second tubulars.

22. The method of claim 20, wherein at least one piston and cylinder unit is actuated by hydraulic or pneumatic fluid to move the at least one guide towards the first tubular.

23. An apparatus for connecting a first tubular to a second tubular, comprising:

a tong moveable into a gripping arrangement with the first tubular;

a backup unit moveable into a gripping arrangement with the second tubular; and a guide assembly arranged on the tong or the backup unit, the guide assembly disposed adjacent the first or second tubular and moveable into a guiding arrangement with one of the tubulars while permitting one of the tubulars to move through the guide assembly, wherein the tong is capable of applying torque to rotate the first tubular relative to the second tubular.

24. The apparatus of claim 23, wherein the guide assembly is arranged on the backup unit and the guide assembly comprises a guide moveable towards and away from a centerline of the second tubular with respect to the backup unit.

25. The apparatus of claim 24, wherein the guide assembly further comprises a torsion post and the guide is moveable around the torsion post towards and away from the centerline of the second tubular.

26. The apparatus of claim 23, wherein the guide assembly is arranged on the tong and the guide assembly comprises a guide moveable towards and away from a centerline of the first tubular with respect to the tong to encircle one of the tubulars.

27. The apparatus of claim 26, wherein the guide assembly further comprises a torsion post and the guide is moveable around the torsion post towards and away from the centerline of the first tubular.

28. The apparatus of claim 23, wherein the tong comprises jaws moveable towards and away from a centerline of the first tubular.

29. The apparatus of claim 23, wherein the backup unit comprises jaws moveable towards and away from a centerline of the second tubular.

30. The apparatus of claim 23, wherein the guide assembly urges the one of the tubulars into coaxial alignment with another of the tubulars.

31. The apparatus of claim 30, wherein the guide assembly is moveable to encircle one of the tubulars.

32. An apparatus for connecting a first tubular to a second tubular, comprising:

a tong moveable into a gripping arrangement with the first tubular;

a backup unit moveable into a gripping arrangement with the second tubular; and a guide assembly arranged on the tong or the backup unit, the guide assembly disposed adjacent the first or second tubular and moveable into a guiding arrangement with one of the tubulars while permitting one of the tubulars to move through the guide assembly, wherein:

the guide assembly urges the one of the tubulars into coaxial alignment with another of the tubulars and is moveable to encircle one of the tubulars; and the guide assembly includes at least two guide portions articulatable around at least two torsion posts mounted on the tong or the backup unit, each guide portion articulatable around its respective torsion post to encircle one of the tubulars with the at least two guide portions.

33. A method for aligning first and second tubulars, comprising:

using an apparatus for aligning first and second tubulars, comprising:

at least one guide, a tong, and a backup unit, the backup unit comprising jaws moveable towards and away from the first tubular and the tong comprising jaws moveable towards and away from the second tubular, wherein:

the at least one guide is arranged on the tong or the backup unit, the at least one guide is movable towards and away from the first or second tubular with respect to the backup unit, and the backup unit and the tong are moveable into gripping engagement with the first and second tubulars, respectively;

moving the at least one guide towards and away from the first tubular with respect to the backup unit while the backup unit grippingly engages the first tubular; and rotating the second tubular relative to the first tubular using the tong to apply torque to the second tubular.

* * * * *